US008683651B2

(12) United States Patent
Liermann

(10) Patent No.: US 8,683,651 B2
(45) Date of Patent: Apr. 1, 2014

(54) DOOR HINGE

(75) Inventor: Nicolas Liermann, Rheda-Wiedenbrucek (DE)

(73) Assignee: Simonswerk, Gesellschaft mit beschraenkter Haftung, Rheda-Wiedenbrueck (DE)

( * ) Notice: Subject to any disclaimer, the term of this patent is extended or adjusted under 35 U.S.C. 154(b) by 0 days.

(21) Appl. No.: 13/470,634

(22) Filed: May 14, 2012

(65) Prior Publication Data

US 2012/0291222 A1 Nov. 22, 2012

(30) Foreign Application Priority Data

May 17, 2011 (DE) ..... 10 2011 050 414

(51) Int. Cl.
*E05D 7/04* (2006.01)

(52) U.S. Cl.
USPC ..... 16/237; 16/235; 16/236

(58) Field of Classification Search
USPC ..... 16/235–238, 242–246, 366, 368–370
See application file for complete search history.

(56) References Cited

U.S. PATENT DOCUMENTS

| | | | | |
|---|---|---|---|---|
| 3,596,307 | A * | 8/1971 | Kolmetsky | 16/237 |
| 3,683,453 | A * | 8/1972 | McLeland et al. | 16/248 |
| 3,863,292 | A * | 2/1975 | Grunert et al. | 16/236 |
| 4,817,241 | A * | 4/1989 | Koch et al. | 16/238 |
| 5,694,665 | A * | 12/1997 | Strickland et al. | 16/238 |
| 6,829,808 | B2 | 12/2004 | Neukoetter | |
| 8,276,241 | B2 * | 10/2012 | Wu et al. | 16/238 |
| 8,413,299 | B2 * | 4/2013 | Bartels | 16/236 |
| 2007/0028420 | A1 * | 2/2007 | Lueffe et al. | 16/382 |
| 2010/0115729 | A1 | 5/2010 | Neukoetter | |

FOREIGN PATENT DOCUMENTS

| | | |
|---|---|---|
| DE | 10 2008 056 327 | 4/2010 |
| DE | 10 2009 038 955 | 3/2011 |
| EP | 1 308 592 | 5/2003 |
| EP | 2 390 446 | 11/2011 |

* cited by examiner

*Primary Examiner* — Victor Batson
*Assistant Examiner* — Matthew Sullivan
(74) *Attorney, Agent, or Firm* — Michael J. Striker

(57) ABSTRACT

A door hinge includes two hinge parts that are connected to each other in articulating fashion. One of the hinge parts has a base plate for attachment to a door frame or door leaf and at least one insert that is adjustable in two directions (x, y, z) relative to the base plate. An intermediate piece is situated between the insert and the base plate that is movable relative to the base plate along a first linear guide in a first direction (x). The insert is movable relative to the intermediate piece along a second linear guide in a second direction (z). A fixing means for providing a clamping locking action extends through a front section of the base plate, the intermediate piece and the insert.

12 Claims, 5 Drawing Sheets

Fig. 2A
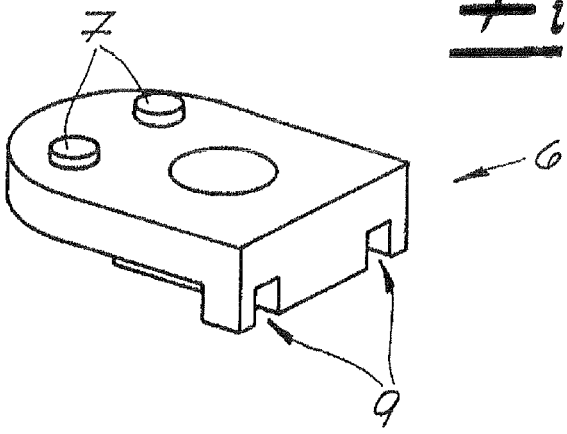
Fig. 2B
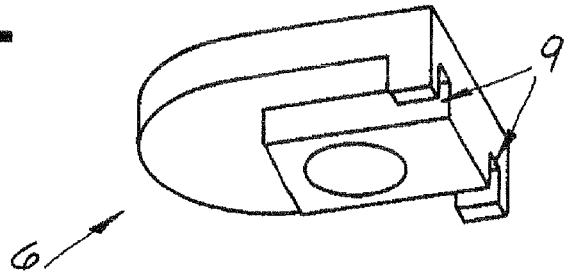
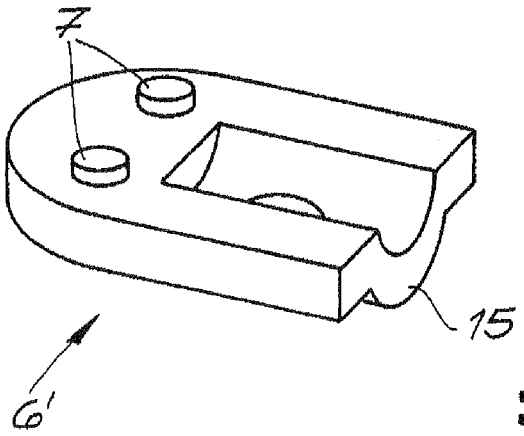
Fig. 5B

DOOR HINGE

CROSS REFERENCE TO RELATED APPLICATIONS

The invention described and claimed hereinbelow is also described in German Patent Application DE 10 2011 050 414.1, filed on May 17, 2011. The German Patent Application, whose subject matter is incorporated by reference herein, provides the basis for a claim of priority of invention under 35 U.S.C. 119(a)-(d). Further, the content of the present application is related to the content of U.S. application Ser. No. 13/463,201, filed May 3, 2012.

BACKGROUND OF THE INVENTION

The invention relates to a door hinge having two hinge parts that are connected in articulating fashion. One of the hinge parts has a base plate for attachment to a door frame or door leaf and at least one insert that is adjustable in two directions relative to the base plate. An intermediate piece is situated between the insert and the base plate that is movable relative to the base plate in a first direction along a first linear guide. The adjustable insert may be embodied in the form of a recess for a hinge flap. Alternatively, the inventive door hinge is provided for a hidden placement between a door leaf and door frame, wherein the hinge parts can be inserted into recesses provided in the door frame and in the narrow edge of the door leaf and are which connected to each other by means of two hinge brackets that can rotate relative to each other.

EP 1 308 592 A2 discloses a door hinge having two hinge parts that are connected in articulating fashion, with one of the hinge parts having a base plate for attachment to a door frame or door leaf and at least one insert that is adjustable in two directions relative to the base plate. The two hinge parts each have a base plate, which, above and below the two hinge brackets that are connected to each other in articulating fashion, has two inserts that are adjustable relative to the base plate. The hinge brackets are secured to the inserts, with each of the inserts accommodating one of the hinge brackets in rotary fashion and the other of the hinge brackets in a manner that allows it to rotate and slide along a sliding guide.

On one of the hinge parts, the inserts are adjustable in the vertical direction relative to the base plate. A groove guide extending in the vertical direction is provided along with adjusting cams that act on the inserts and are supported on the base plate. On the other hinge part, an adjustment is provided in two directions that are perpendicular to each other, permitting an adjustment parallel to the front side of the hinge parts by means of oblong holes. The corresponding adjustment is used to adjust the position of the closed door leaf perpendicular to the surface of the door leaf. This adjustment is used to adjust the outer surface of the door relative to the matching surface of a door frame, thus also changing the pressure exerted on a door seal.

The corresponding horizontal adjustment is therefore referred to in the trade as the closing pressure adjustment. An adjustment perpendicular to the front side of the corresponding hinge part is enabled by an adjusting screw. This adjustment is used to adjust the gap relative to the frame on both sides when a door leaf is closed. The corresponding adjustment is therefore known in the trade as lateral adjustment.

DE 10 2009 038 955 A1 discloses a door hinge having two hinge parts that are connected in articulating fashion, where one of the hinge parts has a base plate for attachment to a door frame or door leaf and having at least one insert that is adjustable in two directions relative to the base plate. A lateral adjustment is carried out by means of an adjusting screw and a closing pressure adjustment perpendicular thereto is carried out by means of at least one oblong hole. The adjusting screw is situated between a front plate and a back plate. Enabling an additional adjustment in another horizontal direction requires at least one additional clamping or intermediate plate. This known door hinge is comparatively complex in design and requires a large number of parts to be screwed to one another.

SUMMARY OF THE INVENTION

The present invention provides a door hinge that overcomes the shortcomings of the known arts.

In an embodiment, a door hinge is provided for a hidden placement between a door leaf and door frame, wherein the hinge parts can be inserted into recesses provided in the door frame and in the narrow edge of the door leaf and are which connected to each other by means of two hinge brackets that can rotate relative to each other.

In another embodiment, a door hinge is provided having two hinge parts that are connected in articulating fashion, in which one of the hinge parts is provided with an adjustment in two directions through simply designed means. That is, one of the hinge parts has a base plate for attachment to a door frame or door leaf and at least one insert that is adjustable in two directions relative to the base plate. An intermediate piece is situated between the insert and the base plate that is movable relative to the base plate in a first direction along a first linear guide. The adjustable insert may be embodied in the form of a recess for a hinge flap. The insert is movable relative to the intermediate piece in a second direction along a second linear guide and in that a fixing means for providing a clamping locking action extends through a front section of the base plate, the intermediate piece, and the insert.

The first and second linear guides provide a precise adjustment in two directions, in particular two directions that are perpendicular to each other, without the base plate being tilted or rotated relative to the insert. The first and second linear guides provide for the adjustment in a simple way on the comparatively small intermediate piece.

In one form, the first and second linear guides may be formed of oblong holes or groove guides. To produce a groove guide, at least one protrusion provided on one of the parts to be guided relative to each other is accommodated in a groove provided in the other part. In one form, an oblong protrusion extends in the direction of the linear guide and in another form, two protrusions are spaced apart from each other in order to prevent a tilting relative to the provided movement direction.

Alternatively, the intermediate piece, in order to form the first linear guide and second linear guide embodied in the form of groove guides, has at least one protrusion that engages in an associated groove in the base plate or the insert. The base plate and the insert can be shaped in a correspondingly simple fashion. The above-described grooves also are easily produced subsequently with a high degree of precision. Since the intermediate piece is only provided to enable the above-described adjustability in two directions, it can be comparatively small and is therefore easy to produce. Apart from the shapes provided for the guidance, a simple plate or disk shape is suitable.

There are thus a variety of possibilities for producing the intermediate piece. The simple shape of the intermediate piece makes it possible to use an injection-molding process. Furthermore, the intermediate piece can be formed as a shaped piece of sheet metal, which merely requires a stamping procedure. The above-described protrusions can then be formed out of the piece of sheet metal in a simple way. It is also conceivable to insert protrusions in the form of pins or the like into bores in the intermediate piece. In such an embodiment, the protrusions also can be composed of a particularly rugged and/or low-friction material.

Since the intermediate piece is situated between the base plate and the insert, the first linear guide on the one hand and the second linear guide on the other are suitably situated on opposite sides of the intermediate piece.

When a fixing means is loosened, the base plate can be moved in a controlled fashion relative to the insert, along the two linear guides without tilting. The fixing means can, for example, be a screw that engages in a threaded piece. In that case, tightening the screw causes the threaded piece to pull the insert and the intermediate piece against the base plate in a clamping fashion.

In another embodiment, two hinge brackets that cooperate in articulating fashion are provided as the connection between the hinge parts. The hinge parts each have a base plate and two inserts. Each of the inserts accommodates one of the hinge brackets in rotary fashion and the other of the hinge brackets in a manner that allows it to rotate and slide along a sliding guide of the insert.

Such hinge parts can e provided for a hidden placement between the door leaf and door frame, in recesses provided in the frame and in the narrow edge of the door leaf.

The intermediate piece enables an adjustment in two directions that are preferably perpendicular to each other. In particular, it is possible for the at least one insert to be adjustable relative to the base plate along a vertical direction extending parallel to a pivot axis of the door hinge and perpendicular thereto along a horizontal direction. With regard to the closed position of the door leaf, an adjustment can be carried out in an additional horizontal direction on the other hinge part, thus producing a door hinge that is adjustable in a total of three directions.

In one form, the insert is an injection-molded metal part. This achieves the advantage that the shapes provided to produce the second linear guide are comparatively simple and can be easily produced using a metal injection molding process. Alternatively, a groove can be subsequently produced in an injection-molded metal part. This enables a particularly inexpensive manufacture. In order to minimize overall production costs while simultaneously achieving good stability and function of the door hinge, the base plate can be formed as a one-piece component composed of sheet metal. Here, too, it is easy to produce the shapes required for the first linear guide.

In an embodiment, the door hinge includes two hinge parts that are connected to each other in articulating fashion. One of the hinge parts has a base plate for attachment to a door frame or door leaf and at least one insert that is adjustable in two directions (x, y, z) relative to the base plate. An intermediate piece is situated between the insert and the base plate that is movable relative to the base plate along a first linear guide in a first direction (x). The insert is movable relative to the intermediate piece along a second linear guide in a second direction (z). A fixing means for providing a clamping locking action extends through a front section of the base plate, the intermediate piece and the insert

BRIEF DESCRIPTION OF THE DRAWING FIGURES

Further features and advantages of the invention will become apparent from the description of embodiments that follows, with reference to the attached figures, in which:

FIG. 2A depicts a top side of an intermediate piece of the door hinge;

FIG. 2B depicts a bottom view of the intermediate piece depicted in FIG. 2A;

FIG. 5B an intermediate piece of the door hinge depicted in from FIG. 5A.

DETAILED DESCRIPTION OF THE PREFERRED EMBODIMENTS

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 3:
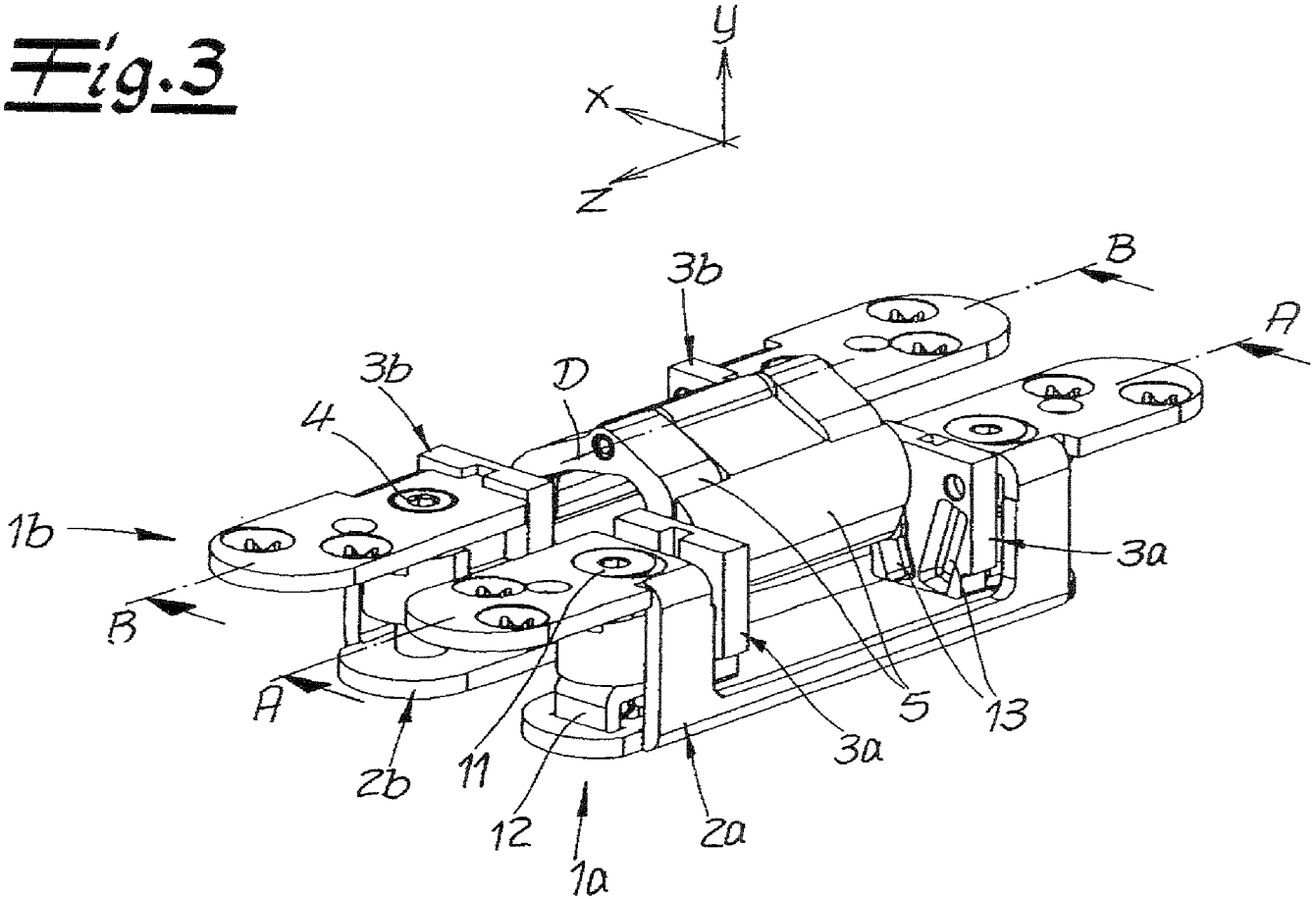
FIG. 3 is a perspective view of the door hinge depicted in FIG. 1.

The invention provides a door hinge 1 having two hinge parts 1*a*, 1*b* that are connected in articulating fashion. One of the hinge parts 1*a* has a base plate 2*a* for attachment to a door frame or door leaf and at least one insert 3*a* that is adjustable in two directions relative to the base plate 2*a*. FIG. 3 one embodiment of such a door hinge. Therein, the two hinge parts 1*a*, 1*b* each have a base plate 2*a*, 2*b* and two inserts 3*a*, 3*b*. The inserts 3*a* of the first hinge part 1*a* are adjustable in the vertical direction z and in a first horizontal direction x perpendicular thereto relative to the associated base plate 2*a* with respect to the customary placement of the door hinge 1 when installed. The second hinge part 1*b* is provided with an additional adjustment in a second horizontal direction y perpendicular to the front side of the corresponding base plate 2*b*. In the second hinge part 1*b*, the inserts 3*b* can each be positioned relative to the associated base plate 2*b* by means of a respective adjusting screw 4.

Figure 1:
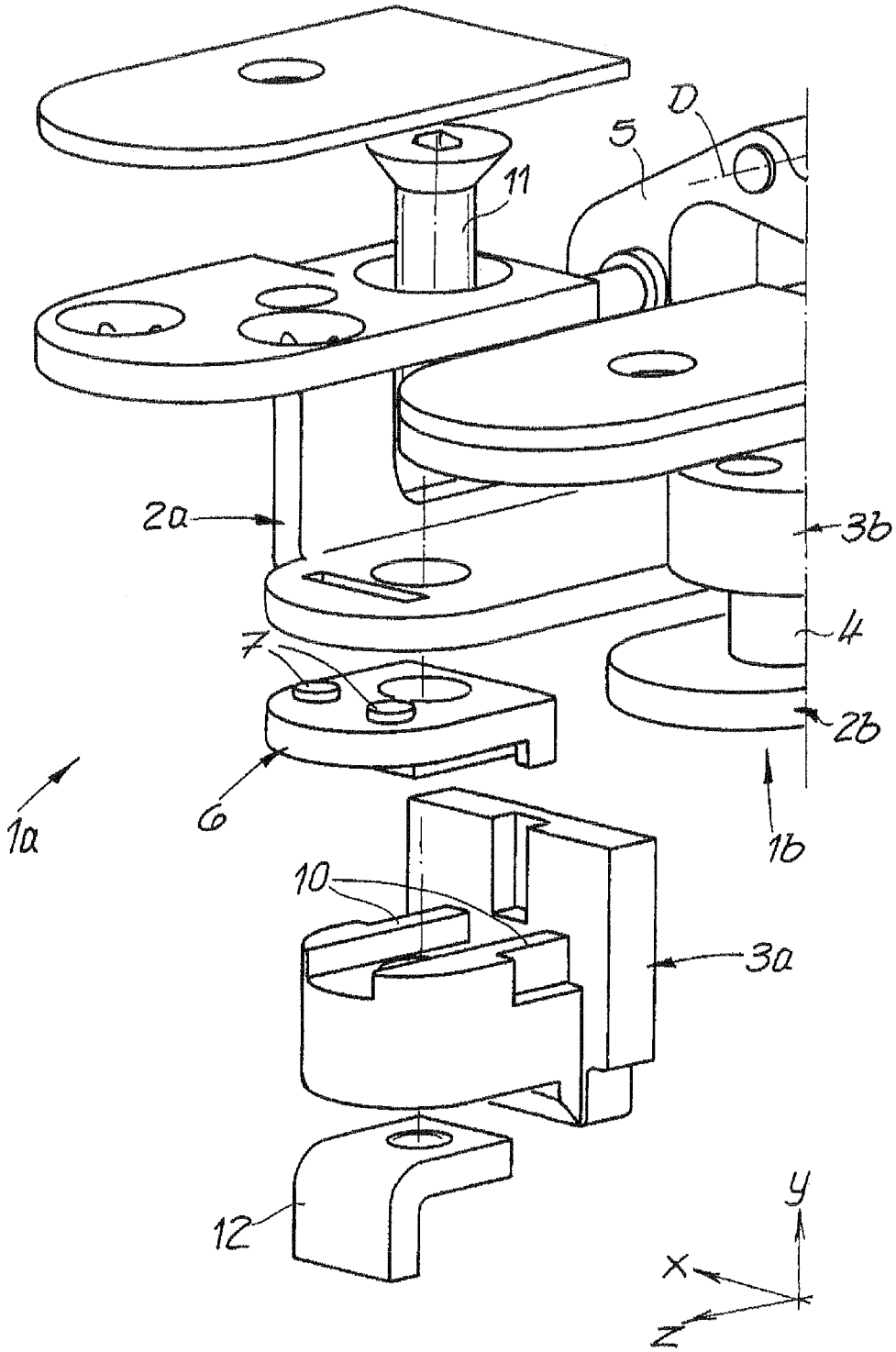
FIG. 1 depicts an exploded view of a door hinge according to the invention.

The precise embodiment of the first hinge part 1*a* is shown in detail in the exploded view of FIG. 1. As seen therein, insert 3*a* is provided above and below the hinge brackets 5, which are connected to each other at a rotation axis D. An intermediate piece 6 is situated between each of the inserts 3*a* and a front section of the base plate 2*a*. The intermediate piece 6 is formed as a plate and has shapes on its top and bottom surface. The shapes form a first linear guide in cooperation with associated shapes on the base plate 2*a* and form a second linear guide in cooperation with associated shapes on the insert 3*a*.

The intermediate piece 6 has two protrusions 7 on its top surface. The two protrusion engage in a groove 8 extending along the first horizontal direction x and thus cooperate with the groove 8 to form a groove guide. The groove 8 is hidden from view in FIG. 1.

FIG. 2B shows that the intermediate piece 6 has slots 9 on its underside, which in the installed state, extend in the vertical direction z and are engaged by the ribs 10 of the associated insert 3*a*. The slots 9 and ribs 10 cooperate to form the above-described second linear guide.

With the two intermediate pieces 6, the two inserts 3*a* of the first hinge part 1*a* can be precisely adjusted relative to the base plate 2. The two linear guides prevent the occurrence of tilting.

In order to fix the inserts 3*a* in the desired, in an adjusted position relative to the base plate 2*a* on the first hinge part 1*a*, a fixing means in the form of a screw 11 is provided. The fixing means or screw 11 extends through a front section of the base plate 2*a*, the intermediate piece 6, and the associated insert 3*a* and engages in a thread of a threaded piece 12 situated underneath the insert 3*a*. Tightening the screw 11 causes the threaded piece 12 to pull the insert 3*a* and the intermediate piece 6 against the base plate 2*a* in a clamping fashion. In the fixed state, the door hinge is secured against unintended adjustment. Adjustment is re-enabled once the screw 11 is loosened.

As is shown in FIG. 3, the hinge brackets 5 that are connected to each other at the rotation axis D connect the two hinge parts 1*a*, 1*b*. The hinge brackets 5 are each secured to the inserts 3*a*, 3*b* of one of the hinge parts 1*a*, 1*b* in rotary fashion and to the inserts 3*b*, 3*a* of the other hinge bracket 1*b*, 1*a* to allow them to slide along a sliding guide 13. FIG. 3 shows a modification of such an intrinsically known arrangement in which two sliding guides 13 are situated in each insert 3*a*, 3*b*, with one of the sliding guides 13 remaining unoccupied. Such modification is advantageous in that the inserts 3*a*, 3*b* can be inserted on both the left and right side, i.e. both above and, rotated by 180°, below the hinge bracket 5 in one of the hinge parts 1*a*, 1*b*.

Figure 4A:
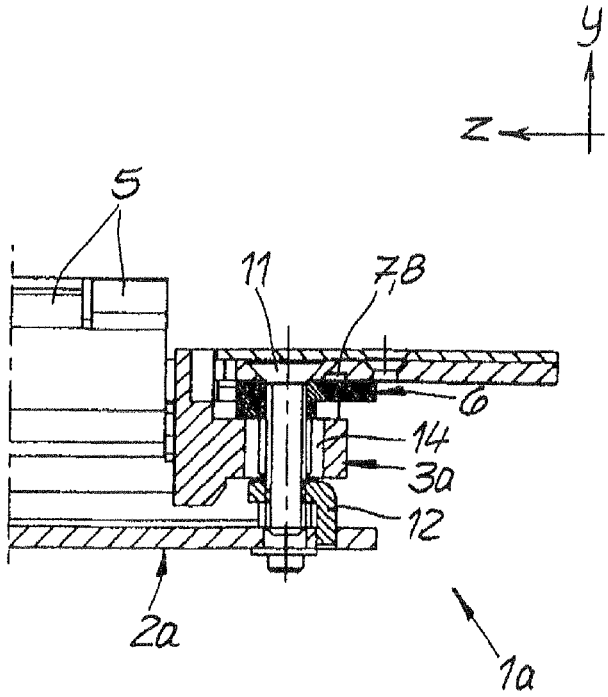
FIG. 4A depicts a section view taken along a line A-A, as shown in FIG. 3.

The placement of the intermediate piece 6 between the base plate 2*a* of the first hinge part 1*a* and the corresponding insert 3*a* also is visible in FIG. 4A, which shows a section along the line A-A in FIG. 3. The inserts 3*a* of the first hinge part 1*a* have oblong holes 14 extending in the vertical direction z that enables an adjustment in the vertical direction z. Ribs 10 of the inserts 3*a* are guided in the slots 9 of the intermediate piece 6. An adjustment perpendicular thereto along the first horizontal direction x is possible through a cooperation of the protrusions 7 of the intermediate piece 6 with the groove 8. Groove 8 is provided on the underside of a front section of the base plate 2*a*. The oblong hole 14 visible in FIG. 4A correspondingly displays a sufficient degree of lateral play along the first horizontal direction x.

Figure 4B:
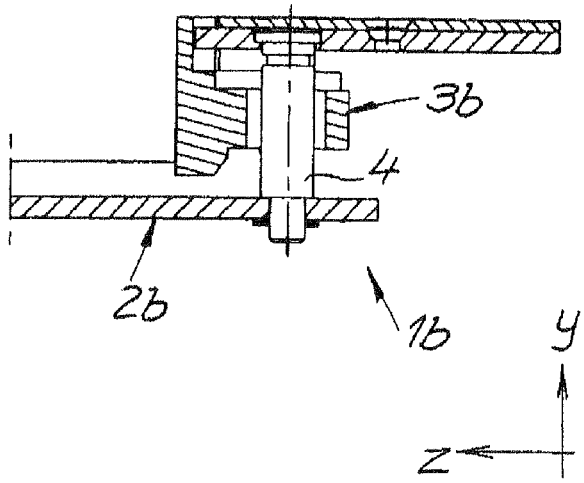
FIG. 4B depicts a section view taken along the line B-B, as shown in FIG. 3.

FIG. 4B shows the placement of the insert 3*b* on the second hinge part 1*b*. Such arrangement allows for the insert 3*b* to be adjusted by means of the above-described adjusting screw 4 perpendicular to the front side of the base plate 2*b* along the second horizontal direction y. With regard to the closed door leaf, there is an adjustability in three directions x, y, z, which are perpendicular to one another so that a precise adjustment of the door leaf is possible with simple means.

Figure 5A:
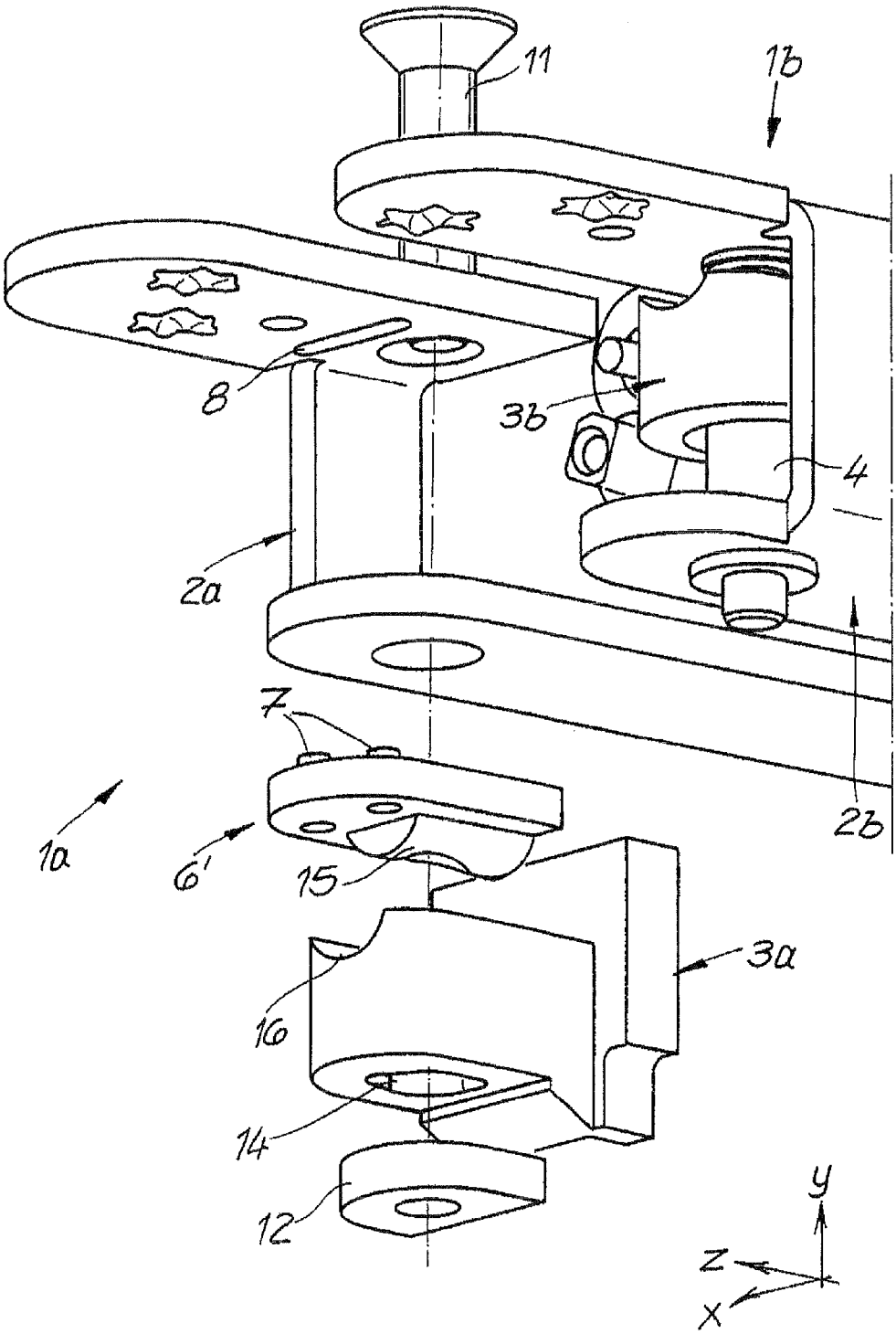
FIG. 5A depicts a partial exploded view of an alternative embodiment of a door hinge according to the invention.

FIGS. 5A and 5B show an alternative embodiment of the door hinge. Thereon, a wide, arched shape 15 is provided on the underside of the intermediate piece 6', which is guided in the vertical direction in cooperation with a complementary recess 16 in the insert 3*a*. The shape 15 and the recess 16 thus constitute the second linear guide in a form similar to a groove guide. The first linear guide is embodied as described above. The groove 8 provided in the base plate 2*a* is visible in FIG. 5A.

A comparison of FIGS. 5A and 5B shows that the intermediate piece 6' is easy to produce by shaping a piece of sheet metal. The thickness of the intermediate piece 6' remains approximately the same at different locations. The shape 15 on the underside and the protrusions 7 projecting upward can be produced by sheet metal shaping procedures.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A door hinge (1) having two hinge parts (1*a*, 1*b*) that are connected by hinge brackets in articulating fashion, wherein each of the hinge parts (1*a*, 1*b*) comprises a base plate (2*a*) for attachment to a door frame or door leaf, at least one insert (3*a*) that is connected to the base plate and is adjustable in a first direction and a second direction relative to the base plate (2*a*), at least one of the hinge parts (1*a*) having an intermediate piece (6, 6') being situated between each insert (3*a*) and the base plate (2*a*), wherein the intermediate piece (6, 6') is movable in the first direction (x) relative to the base plate (2*a*) along a first linear guide formed between the intermediate piece and the base plate, wherein at least one of the inserts (3*a*) is movable in the second direction (z) relative to the intermediate piece (6, 6') along a second linear guide formed between the insert and the intermediate piece, wherein a fixing means provides a clamping locking action extending through a front section of the base plate (2*a*), the intermediate piece (6, 6'), and the insert (3*a*), wherein the fixing means comprises a screw (11) that engages in a threaded piece (12), and wherein tightening the screw (11) causes the threaded piece (12) to pull the insert (3*a*) and the intermediate piece (6, 6') against the base plate (2*a*) in a clamping fashion.

2. The door hinge (1) as recited in claim 1, wherein the first linear guide and/or the second linear guide is formed as a groove guide.

3. The door hinge (1) as recited in claim 2, wherein the intermediate piece (6, 6') has at least one respective protrusion (7) that engages in an associated groove (8) in the base plate (2*a*) and the insert (3*a*), respectively, to form the guide grooves of each of the first and second linear guides.

4. The door hinge (1) as recited in claim 1, wherein the first linear guide and the second linear guide are provided on opposite sides of the intermediate piece (6, 6').

5. A door hinge (1), comprising two hinge parts (1*a*, 1*b*) and two hinge brackets (5), wherein the two hinge parts (1*a*, 1*b*) are connected to each other in an articulating fashion using the interconnected hinge brackets (5), wherein at least one of the hinge parts (1*a*) comprises a base plate (2*a*) for attachment to a door frame or door leaf, at least one insert (3*a*) that is connected to the base plate, includes a sliding guide (13) and is adjustable in a first direction and a second direction relative to the base plate (2*a*), wherein an intermediate piece (6, 6') is situated between each insert (3*a*) and the base plate (2*a*), wherein at least one of the inserts (3*a*) accommodates one of the interconnected hinge brackets (5) in rotary fashion and the other of the interconnected hinge brackets (5) in a manner that allows the other of the interconnected hinge brackets to rotate and slide along the sliding guide (13) of the at least one of the inserts (3*a*), and wherein a fixing means provides a clamping locking action extending through a front section of the base plate (2*a*), the intermediate piece (6, 6'), and the insert (3*a*) that pulls the insert (3*a*) and the intermediate piece (6, 6') against the base plate (2*a*) in a clamping fashion.

6. The door hinge (1) as recited in claim 5, wherein the hinge parts (1*a*, 1*b*) are provided for a hidden placement between the door leaf and door frame, in recesses provided in the frame and in the narrow edge of the door leaf.

7. The door hinge (1) as recited in claim 1, wherein the intermediate piece (6, 6') is composed of a shaped piece of sheet metal.

8. The door hinge (1) as recited in claim 1, wherein the insert (3*a*) is adjustable relative to the base plate (2*a*) along a vertical direction (z) extending parallel to a pivot axis of the door hinge and perpendicular thereto along a horizontal direction (x).

9. The door hinge (1) as recited in claim 1, wherein the insert (3*a*) is an injection-molded metal part.

10. The door hinge (1) as recited in claim 1, wherein the two hinge parts (1*a*, 1*b*) provide for adjusting the door hinge (1) in the second direction (z), the first direction (x) and a third direction (y) relative to the door frame, wherein said directions are perpendicular to each other with regard to a closed position of the door leaf and wherein the adjustment in the third direction (y) is performed by adjusting said insert (3*b*) in the other one of the hinge parts (1*b*).

11. The door hinge (1) as recited in claim 1, wherein the base plate (2*a*) is embodied in the form of a one-piece component composed of sheet metal.

12. The door hinge (1) as recited in claim 5, wherein the fixing means comprises a screw (11) that engages in a threaded piece (12) such that tightening the screw (11) causes the threaded piece (12) to pull the insert (3*a*) and the intermediate piece (6, 6') against the base plate (2*a*) in the clamping fashion.

* * * * *